United States Patent [19]

Petrini et al.

[11] Patent Number: 4,577,420

[45] Date of Patent: Mar. 25, 1986

[54] SKI BOOT

[75] Inventors: Roland Petrini, Chambery; Serge Pradier, Alby-sur-Cheran; Michel Mabboux, Seynod, all of France

[73] Assignee: Salomon S.A., Annecy, France

[21] Appl. No.: 614,048

[22] Filed: May 25, 1984

[30] Foreign Application Priority Data

May 30, 1983 [FR] France ..... 83 09449

[51] Int. Cl.[4] ..... A43B 5/04

[52] U.S. Cl. ..... 36/117; 36/120

[58] Field of Search ..... 36/117–121, 36/50; 24/68 SK, 598, 129 A, 130, 189, 194, 281

[56] References Cited

U.S. PATENT DOCUMENTS

| | | | |
|---|---|---|---|
| 405,876 | 6/1889 | Corning | 24/598 |
| 3,678,539 | 7/1972 | Graup | 24/68 SK |
| 4,186,501 | 2/1980 | Salomon | 36/121 |
| 4,372,061 | 2/1983 | Pozzobon | 36/117 |
| 4,381,613 | 5/1983 | Lederer | 36/121 |
| 4,455,768 | 6/1984 | Salomon | 36/121 |

FOREIGN PATENT DOCUMENTS

| | | | |
|---|---|---|---|
| 3219772 | 1/1983 | Fed. Rep. of Germany | 36/120 |
| 2480575 | 10/1981 | France . | |
| 2484800 | 12/1981 | France . | |

*Primary Examiner*—James Kee Chi

*Attorney, Agent, or Firm*—Sandler & Greenblum

[57] ABSTRACT

A ski boot having an upper which is partially journalled on a shell base. The upper includes a front and rear portion. The front portion or cuff is adapted to flex forward with respect to the shell base. Also provided is a control means for controlling the rigidity and flexional characteristics of the boot. The control means includes a flexion band having an arch which extends over the instep of the boot, and also includes two substantially horizontal lateral arms each attached to one end of the arch and extending over each lateral side of the shell base. Each lateral arm is connected to the bottom front portion of the cuff. The arch comprises a first deformation zone and the two lateral arms comprise second deformation zones. The flexion band also includes a means for maintaining a portion of the flexion band in a fixed position with respect the shell base. This means is positioned substantially in a zone in which the arch is connected to each lateral arm. In addition, the cuff also includes a groove, above the flexion band, which extends across the instep of the boot. A cursor is adapted to be displaced at any position along the groove to transmit the flexion force from the lower portion of the cuff to the flexion band.

31 Claims, 8 Drawing Figures

SKI BOOT

BACKGROUND OF THE INVENTION

1. Field of the Invention

The present invention relates to a ski boot of the type described in French Pat. No. 2,480,575 filed Apr. 17, 1980 which corresponds to U.S. Pat. No. 4,455,768 filed Apr. 17, 1981. More particularly, the boot comprises an upper which is at least partially journalled on a rigid shell base and an adjustment apparatus which adjusts the flexional characteristics of the upper with respect to the sheel base.

2. Description of the Prior Art

French Pat. No. 2,480,575 and its corresponding U.S. Pat. No. 4,455,768 filed Apr. 17, 1981 relate to a ski boot having an upper at least partially journalled on a shell base. The boot includes an adjustment apparatus. This adjustment apparatus adjusts the flexional characteristics of the upper with respect to the shell base. It is positioned over at least a portion of the lower periphery of the upper, generally in the zone extending from the flexion fold of the boot to the instep. The upper is composed of a support surface on support means for supporting the leg of the skier which are known in the art, and are provided in front of the upper. The support means transmits the flexional forces of the leg of the skier to a flexional element which cooperates with the rigid shell base by means of at least one stop. This stop is adapted to transmit the flexional forces from the leg and the upper to the rigid shell base and is slidably mounted in a slot positioned between the support surface and the flexional element.

SUMMARY OF THE INVENTION

The ski boot described in the above-identified application comprises various flexional elements which control the flexional movement of the leg of the skier. Various studies and test have been conducted by Applicants to improve the mechanical properties and functioning of this flexion control apparatus. As a result, the ski boot of the present invention has been developed which is an improvement on this flexion control apparatus. The present invention relates to a boot comprising a cuff having a groove at its lower portion which extends from a malleoli zone on one side of the boot to the malleoli zone on the other side of the boot, positioned substantially on the periphery of the instep. The groove defines, at the lower anterior portion of the cuff, a flexion band. This flexion band is integral with a portion of the cuff and preferably, comprises an arch which defines the top of the shell base in the zone of the instep. The flexion band also comporises two horizontal arms each extending from one end of the arch. Each arm is also connected to the cuff assembly at one end thereof. A journal rivet generally situated at the end of the horizontal arms attached to the cuff, connects the cuff to the shell base substantially in the malleoli zone. In addition, a second blocking rivet is provided to maintain each of the ends of the flexion band on the shell base in a zone situated at the intersection of the arch with the horizontal arms.

Such a construction makes it possible to provide a flexion band having different work zones which can be simultaneously or separately biased depending on the adjustment of a transmission means or cursor which adjusts the transmission of the flexion forces from the cuff to the shell base.

According to another aspect of the present invention, the boot comprises an upper having front and rear portions surrounding the lower portion of the leg, and a journal axis element around which the two portions are adapted to pivot. As a result, the boot can be opened for insertion of the foot by pivoting the rear portion rearward, and pivoting the front portion forward. Also included is a control and adjustment apparatus for adjusting the flexion of the upper with respect to the shell base. The flexion control apparatus comprises a flexion band at the periphery of the instep zone of the boot. This flexion control apparatus also comprises two substantially horizontal arms which extend from each side of the shell base and which are attached to the bottom of the front portion of the upper generally in the zone of the malleolus. In addition, attachment means for the flexion band are provided in the zone where the horizontal arms intersect a portion of the flexion band. As a result, the flexion band comprises two zones having different deformation characteristics. These two deformation zones on a single band are distributed in a unique manner. The first zone is a zone including the two lateral horizontal arms on the shell base. This zone is adapted to provide the upper with good elasticity. The second zone is provided on the peripheral arch of the instep and is biased by adjustable force transmission means for transmitting the forces of the leg. This zone is adapted to control the flexion itself.

According to another preferred embodiment of the present invention, the invention comprises ski boot having an instep. The ski boot comprises an upper comprising a front portion having a bottom portion thereon, a shell base, having two lateral sides, and a control means for controlling the rigidity and flexional characteristics of the boot. The control means comprises a flexion band comprising an arch having two ends. The arch extends across the instep of the boot. In addition, the flexion band further comprises two substantially horizontal lateral arms, each attached to one of the ends of the arch. Each arm extends on one lateral side of the shell base and is connected to the bottom portion of the front portion of the upper. The flexion band also comprises a means for maintaining a portion of the flexion band at a fixed position with respect to the shell base. This fixed position is positioned substantially in a zone in which the arch is connected to each of the lateral arms.

In addition, the shell base may have a top portion, and the arch may be slidably mounted on the top portion of the shell base. In one embodiment, the arch has a constant cross-section. In an alternative embodiment, the arch may have a variable cross-section.

The shell base further comprises a shoulder positioned on at least a portion of the shell base. This shoulder abuts at least a portion of the flexion band.

One end of the arch is an internal end. In addition, the arch may also comprise a lateral internal portion extending from a substantially median point along the length of the arch to the internal end of the arch. The lateral internal portion of the arch comprises the portion of the arch abutting the shoulder of the shell base. The other end of the arch comprises an external end. The arch further comprises a lateral external portion, extending from a substantially median point along the length of the arch to its external end. In one embodiment, the lateral internal portion of the arch abutting the shoulder of the shell base is of constant cross-section and the lateral external portion of the arch is of variable cross-section.

The maintenance means in one embodiment may comprise two fixed rivets. The rivets define first and second deformation zones adapted to be deformed to different extents. The first deformation zone comprises the portion of the lateral arms extending from the end connected to the upper to the rivet. The second deformation zone comprises the portion of the arch extending between the two rivets.

In addition, the boot may further comprise an adjustment means for adjusting the position of the maintenance means. The adjustment means are positioned on each side of the boot. In this embodiment, the first deformation zone extends from the end of the lateral arm connected to the upper to the adjustment means. The second deformation zone extends between the fixed pints along the arch.

In another embodiment of the invention, the upper is at least partially journalled on the shell base. A journal element can be proided spaced from the fixed position and around which the upper is journalled with respect to the shell base. In this embodiment, the lateral arms extend continuously between the fixed position and the journal element. In addition, the lateral arms may be elastically deformable, and the arch is deformable. Also, the journal element may extend through the upper to attach the upper to the shell base.

In another embodiment of the invention, the boot comprises a shell base having two lateral sides, and an upper at least partially journalled at a journal point on the shell base. This upper comprises a front portion having a bottom portion thereon. Also included is a flexion band integral with the upper. The flexion band comprises an instep portion extending across the instep of the boot and having two ends, and two substantially horizontal arms extending from one of the ends of the instep portion of the flexion band to the bottom portion of the front portion of the uppe. In addition, means are provided for maintaining a portion of each lateral arm in a fixed position with respect to the shell base. This fixed position is spaced from the journal point. In addition, each lateral arm extends continuously between the fixed position and the journal point. In one embodiment, the maintenance means may extend through the lateral arms and connect the lateral arms with the shell base. Also, the boot may further comprise malleoli zones and the journal point in this embodiment is positioned in the malleoli zones of the boot. In one embodiment, the maintenance means may comprise rivets.

In another embodiment, the shell base may comprise a top portion and the instep portion of the flexion band is slidably mounted on the top portion of the shell base.

The upper may further comprise a cuff having a lower portion and a groove between the lower portion of the cuff and the instep portion of the flexion band. Also, a force transmission means may be provided which transmits a flexion force from the lower portion of the cuff to the instep portion of the flexion band. The force transmission means engages the groove and is adapted to be adjusted along the length of the groove in one embodiment. The lower portion of the cuff may be adapted to slide over the shell base and contact the flexion band in response to the forward flexion of the boot. In addition, the groove has a notch at each lower end thereof and intermediate portion between these notches. In one embodiment, each notch has a width greater than the width of the intermediate portion of the groove.

A retaining means may be provided for retaining the force transmission means at any point along the length of the groove.

In addition, the lateral arms are elastically deformable and elastically deform in response to the forward flexion of the boot. Also, the entire flexion band, including the instep portion may be elastically deformable so that it elastically deforms in response to the flexion of the boot.

In one embodiment, the force transmission means comprises at least one cursor. Each cursor is adapted to contact and slide over the lower edge of the cuff and the upper edge of the flexion band. The cursor comprises upper and lower tightening flaps adapted to grip, respectively, the bottom portion of the lower edge of the cuff and top portion of the upper edge of the flexion band. The cursor further comprises tightening means for actuating the tightening flaps to grip the cuff and flexion bands. Also, the cursor may comprise a rounded portion, and the lower edge of the cuff and the upper edge of the flexion band may comprise rounded guide tracks adapted to engage this corresponding rounded portion on the cursor.

BRIEF DESCRIPTION OF THE DRAWINGS

The invention will now be described with reference to the attached drawings given by way of non-limiting example only, in which.

DESCRIPTION OF PREFERRED EMBODIMENTS

Figure 1:
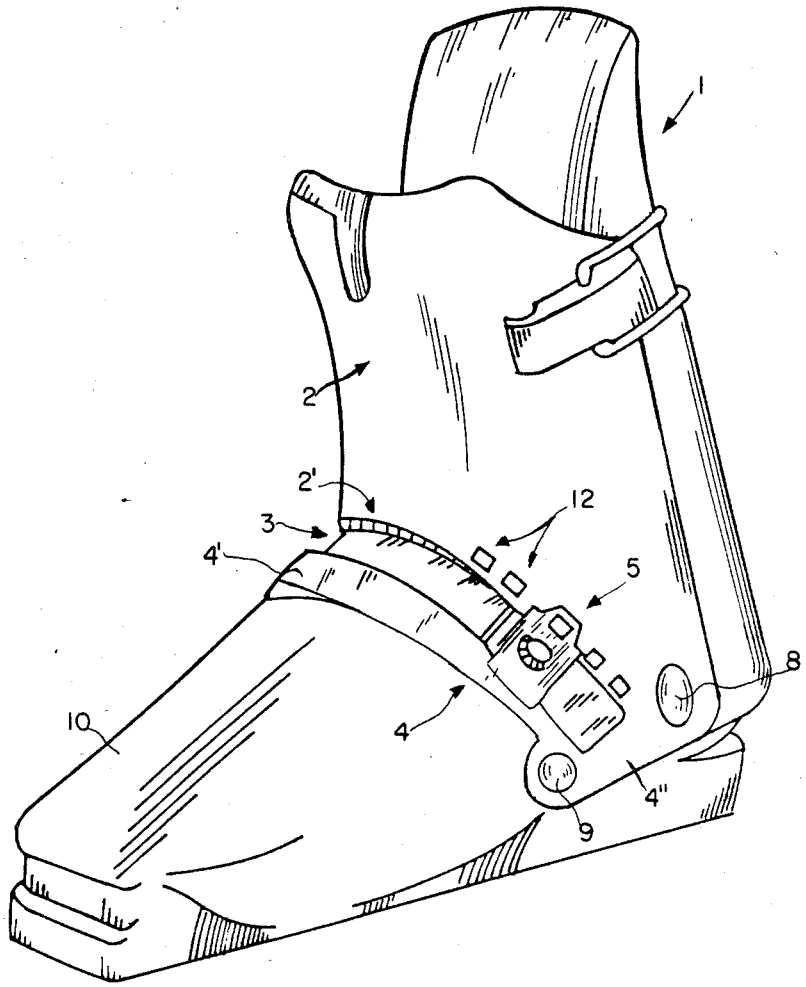
FIG. 1 illustrates a perspective view of a first embodiment of a boot formed according to the invention, in which the entire length of the flexion band having two deformation zones is subjected to flexion forces.
Figure 3:
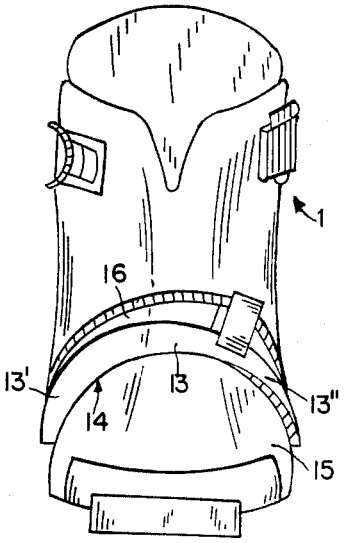
FIG. 3 is a front elevational view of the ski boot shown in FIG. 2, showing the portion of the arch abutting the shell base, located preferably on the external side of the boot.

FIG. 1 illustrates a ski boot 1 of the type described in French Patent Application No. 80 08948 filed Apr. 17, 1980 and the corresponding U.S. application Ser. No. 255,176 filed Apr. 17, 1981, which are both hereby incorporated by reference. Boot 1 comprises an upper having a front cuff portion 2 with a lower anterior portion 2'. A groove 3 is positioned in lower anterior portion 2' and extends over the periphery of the zone of the instep of the boot. This groove 3 comprises a slit in lower zone 2' at the bottom of the cuff which also defines a band 4 composed of a material which forms a substantially peripheral arch 4' across the instep of the boot. Band 4 also comprises two substantially horizontal arms 4'' which extend rearwardly from arch 4' and connect arch 4' to the bottom portion of the front of the cuff. Flexion band 4, thus forms an integral portion of the cuff. Arch 4' and arms 4'' are elastically deformable. Also, arch 4' is adapted to slide on the top portion of shell base 10. In addition, arch 4' can have a constant or variable cross-section along the length thereof. FIGS. 1–7 show an arch having a variable cross section, and FIG. 8 shows an arch having a constant cross section.

Also provided is a force transmission means whch can comprise a cursor or cursors 5 slidably mounted on arch 4' and over groove 3. Means 5 transmits the flexion forces from cuff 2 to shell base 10. The position of cursor 5 is adjustable along groove 3 so as to modify the conditions under which upper endge 6 of band 4' and lower 7 of cuff 2 are brought together.

According to this embodiment of the invention, the flexion band comprises two deformation zones 4' and 4'' which are distinct from one another. Deformation zone 4'' comprises horizontal arms 4'' on each side of boot 1, extending substantially from a journal element or rivet 8 to a rivet called an energizer 9 positioned substantially in a zone in which arch 4' is connected to arms 4'', or more particularly, at the junction of arms 4'' and arch periphery 4'. Energizer 9 comprises means for maintaining a portion of the flexion band at a fixed position with respect to shell base 10. Rivet 9 extends through arms 4'' to shell base 10. However, it is within the scope of the invention to use other means for maintaining one portion of arms 4'' fixed with respect to shell base 10. In addition, this fixed position is spaced from the journal point, and arms 4'' extend continuously from the fixed position 9 to journal point 8. Cuff 2 is adapted to pivot around a journal point on journal rivet 8. Deformation zone 4' comprises arch 4' surrounding the zone of the instep of the boot and extending between rivets 9. Energizer rivet 9 integrates and connects the lower zone of the flexion band with shell base 10.

By virtue of this new type of construction, the boot of the present invention has initial rigidifying characteristics which are defined by the deformation zone of the lateral horizontal arms 4''. Arms 4'' also assure the proper elastic return of the upper after flexional movements have ceased. This intial rigidity is supplemented by the second zone of deformatin defined by arch 4', as will be explained below.

Cursors 5 are adapted to be positioned at various positions along groove 3 to adjust the flexional characteristics of the boot. When cursor 5 is positioned at either end of groove 3, the boot can more easily flex than when cursor 5 is positioned at the midpoint along groove 3.

The operation of the boot of the present invention is similar to several embodiments which comprise flexion bands adapted to slide on top of shell base 10 described in French application No. 80 08948 and U.S. patent application Ser. No. 255,176. When cursors 5 are positioned in the lower portion of groove 3 near the ends thereof, the boot is in a position of maximum flexible adjustment (or minimum rigidity) of cuff 2 with respect to shell base 10. In this position, when the boot experiences a flexional movement, horizontal arms 4'' or a portion thereof are alone subjected to stress. As a result, lower edge 7 of cuff 2 is displaced along the upper portion of shell base 10 in the zone of the instep until it is displaced over the entire width of groove 3 so as to contact upper edge 6 of arch 4', and is then subject to the displacement limitations which this mating between cuff 2 and the band causes.

Figure 6:
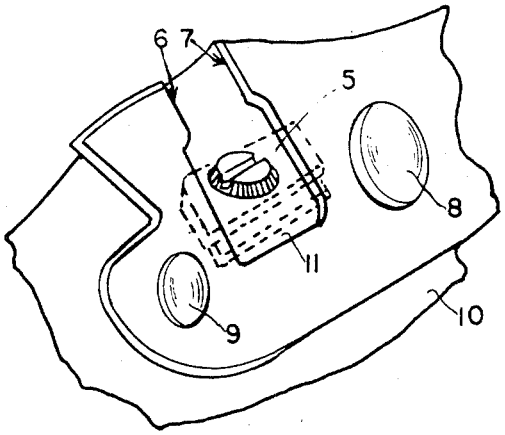
FIG. 6 is an enlarged perspective view of cursor 5, groove 3 and a portion of the boot.

In order to better separate the different zones of deformation of flexion band 4, groove 3 preferably comprises, at its lower portion at the ends thereof, a notch 11 which is wider than the width of groove 3 itself, and is adapted to receive cursor 5 therein, such that the respective edge 7 at the bottom of cuff 2 and edge 6 at the top of flexion band 4 do not come into contact with cursor 5 when cursor 5 is disposed in notch 11. Thus, only the deformation zone defined by horizontal, lateral arms 4'' is deformed by the flexion forces of the skier and provides some resistance to forward flexion of cuff 2. This embodiment is illustrated in FIG. 6.

In a more rigid adjustment position of cuff 2 with respect to shell base 10, the one or more cursors 5 are positioned at various locations along the length of flexion band 4 away from the ends thereof, and outside of lower notch 11. So as to improve the retention of cursor 5 at their various positions along band 4, projections, contacts or adjustment notches 12 are provided on cuff 2. These elements 12 are adapted to engage a portion of cursor 5 so as to hold cursor 5 at a selected position along band 4. For example, when elements 12 comprise notches, cursor 5 comprises projections adapted to engage notches 12. When elements 12 comprise projections, cursor 5 comprises notches adapted to receive projections 12.

When flexional movement occurs for a given selected position of cursor 5 along the length of band 4, lower zone 2' of cuff 2 begins to pivot around journal axis 8. However, this pivoting of cuff 2 is quickly limited by the abutment of the lower edge 7 of cuff 2 with cursor 5, which then transmits the force from edge 7 to arch 4'. As a result, deformation zone 4'' is immediately deformed and then zone 4' is deformed to provide additional resistence to forward flexion of cuff 2. The intensity of the resistence to forward flexion provided by arch 4' is a function of the position of the one or more cursor 5 selected by the skier.

Figure 2:
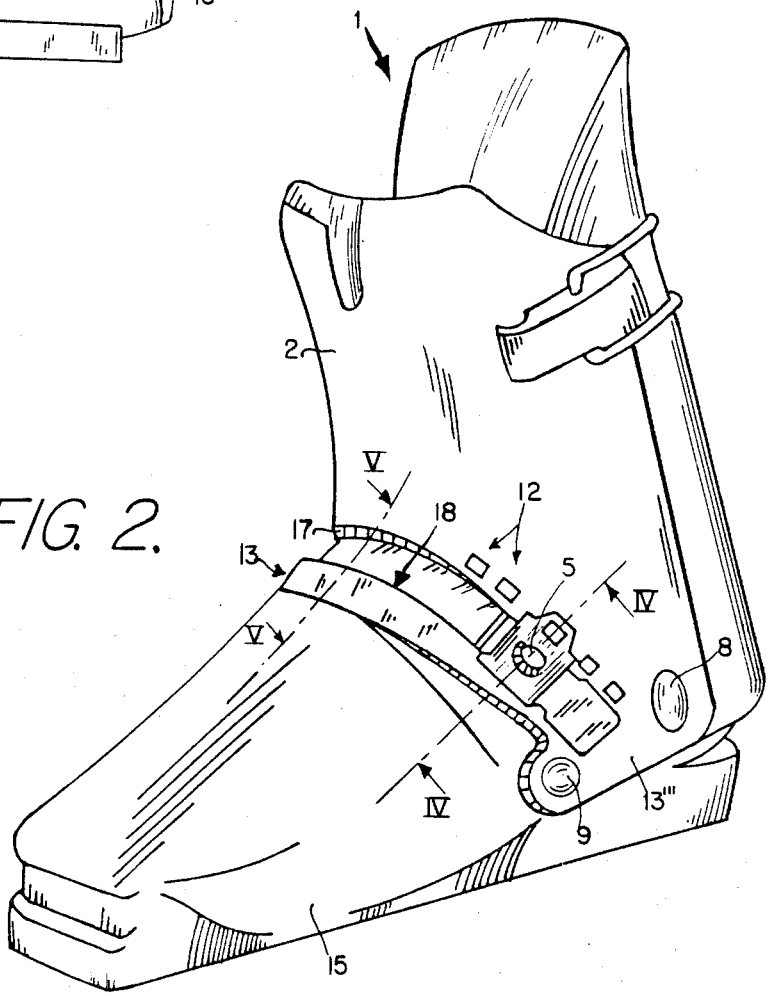
FIG. 2 illustrates a perspective view of an alternative embodiment according to the invention in which the flexion band has two deformation zones and abut the shell base on a portion of its peripheral arch.

FIG. 2 illustrates an embodiment that differs from the preceeding embodiment, in that the lateral internal portion 13' of flexion band 13 abuts a shoulder 14 of shell base 15 which prevents forward movement of this lateral internal portion 13'. In this embodiment, rather than the entire arch 13 acting as a deformation zone to resist forward flexion of cuff 2, only the lateral external portion 13'' of arch 13 acts as a deformation zone conjointly with the zone of lateral arms 13'''. In one embodiment, lateral internal portion 13' of arch 13 extends from substantially the median point along the length of arch 13 to the internal end of arch 13. The internal end and internal portion of arch 13 is that portion of arch 13 facing the boot on the other foot of the skier, whereas the external end and external portion of arch 13 is that portion of arch 13 facing the exterior, away from the boot on the other foot of the skier. The lateral external portion 13'' of arch 13 extends substantially from the median point along the length of arch 13 to the external end of arch 13. In addition, lateral internal portion 13' may have a constant cross-section, and lateral external portion 13'' may have a variable cross-section.

The operation of this embodiment is identical to that of the preceding embodiment when this embodiment is in its flexible adjustment position. However, the operation of this embodiment differs substantially from the preceeding embodiment when its is in its rigid adjustment position. In this position, only the lateral external portion 13" of the arch is subjected to deformation. As a result, boot 1 is initially more rigid (with respect to movement of cuff 2 with respect to shell base 15) than if entire arch 13 were deformable. Furthermore, this embodiment requires only a single force transmission element 5 positioned in groove 16 at a location corresponding to this lateral external portion of the arch. Such a boot, by virtue of the greater rigidity of the upper, is preferably adapted for use by advanced skiers.

Figure 4:
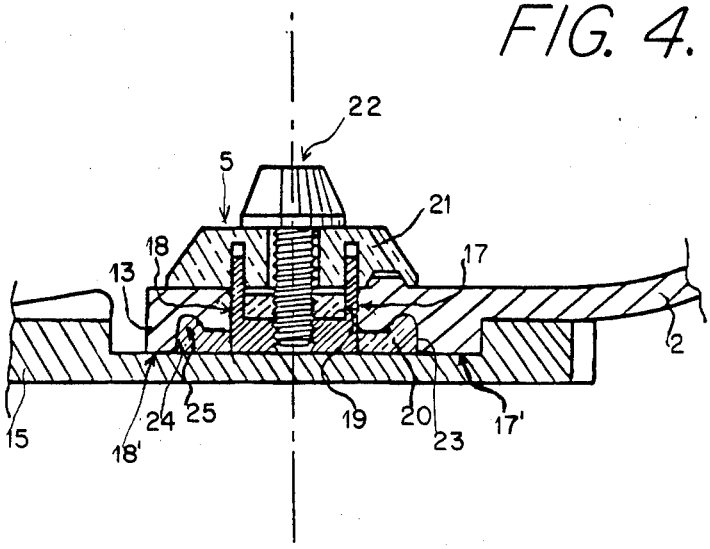
FIGS. 4 and 5 each illustrate a cross-sectional view of the bottom of the front portion of the upper which is provided with an apparatus for controlling the flexion of the boot, respectively, in the zone of the arch abutting the shell based and in the zone of the arch that is biased and deformed by an adjustable means for transmitting flexional forces from the upper to the arch.
Figure 5:
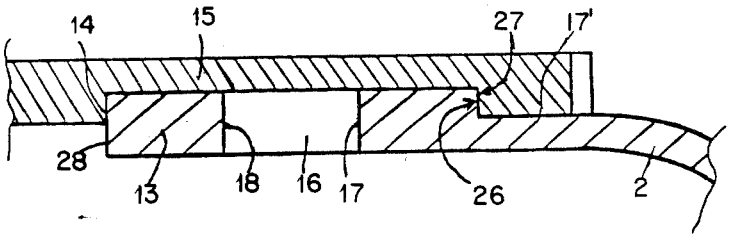

FIGS. 4 and 5 illustrate in detail two partial cross-sectional views of the zone of the instep where flexion band 13 is positioned.

FIG. 4 illustrates an embodiment of force transmitting cursor 5 which is positioned in a median position along the length of flexion band 13. In this position, lower edge or border or base 17 of cuff 2 and upper edge 18 of flexion band 13 are adapted to slide with respect to body 19 of cursor 5 and vice versa. The cursor comprises two lower and upper tightening flaps 20 and 21. Lower flaps 20 grip or pinch the bottom of edges 17 and 18. Upper flaps 21 grip or pinch the top of edges 17 and 18. Flaps 20 and 21 work together to grip or pinch edges 17 and 18 so that cursor 5 is retained in a pre-selected position. The gripping of edges 17 and 18 by the two flaps 20 and 21 is actuated by tightening means 22, which are known in the art, such as for example, a nut and bolt, a cam, etc. To improve the ease of the displacement of cursor 5, rounded guide tracks 23 and 24 are provided on internal surface 17' of edge 17 of the cuff and on internal surface 18' of the upper edge of the flexion band. Guide tracks 23 and 24 are adapted to engage corresponding zones 25 on lower flap 20 of the cursor.

FIG. 5 shows a cross-sectional view of the lateral internal portion of the boot where flexion band 13 abuts shell base 15. The internal surface 17' of the bottom of cuff 2 comprises an abutment surface 26 which is in contact with a shoulder 27 of shell base 15. Groove 16 is disengaged between upper edge 18 of flexion band 13 and edge 17 of cuff 2 and allows cuff 2 to come into contact with its corresponding element, on band 13 during flexion of the boot. In addition, lower edge 28 of flexion band 13 is restrained from movement by another shoulder 14 of shell base 15 which is not adjacent to it except on tis internal lateral portion 13' as may be seen in the front elevational view of FIG. 3.

The two embodiments described above are not limited to these two particular embodiments. Thus, it is possible without going beyond the scope of the invention to vary the characteristics of the respective deformation zones of the flexion band, to modify their configurations, or to change the zones in which the energization rivets are positioned.

Figure 7:
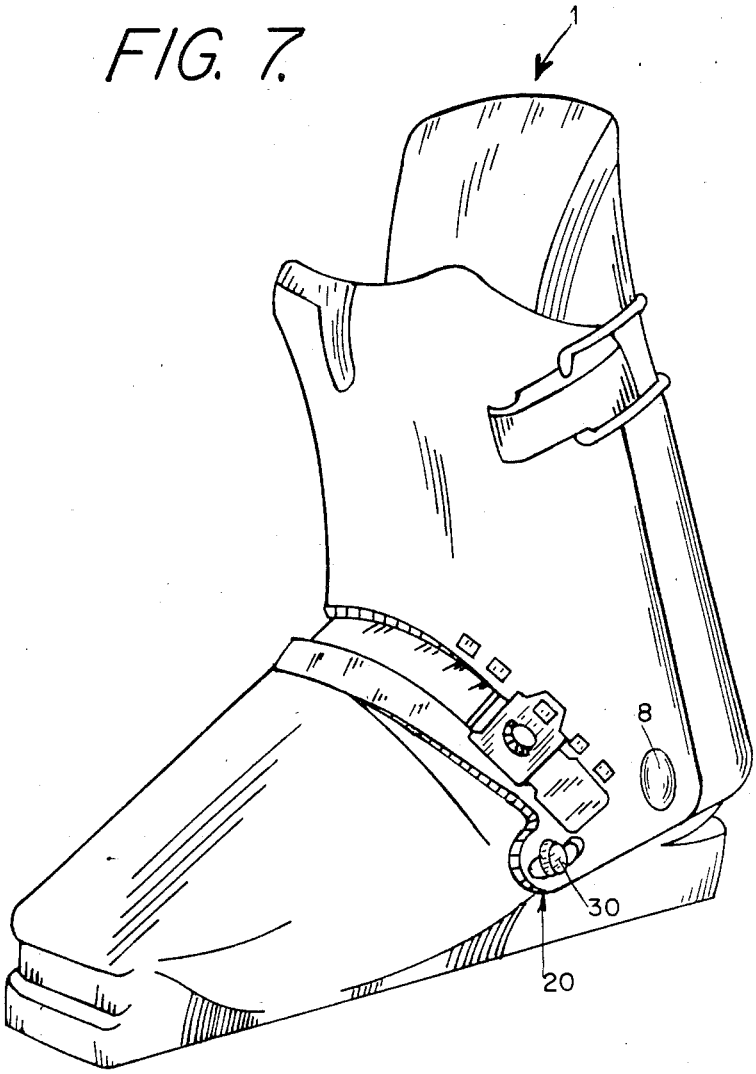
FIG. 7 is a perspective view of an alternative embodiment of the boot having an adjustment apparatus for adjusting the position of the rivets connecting the flexion band with the shell base.
Figure 8:
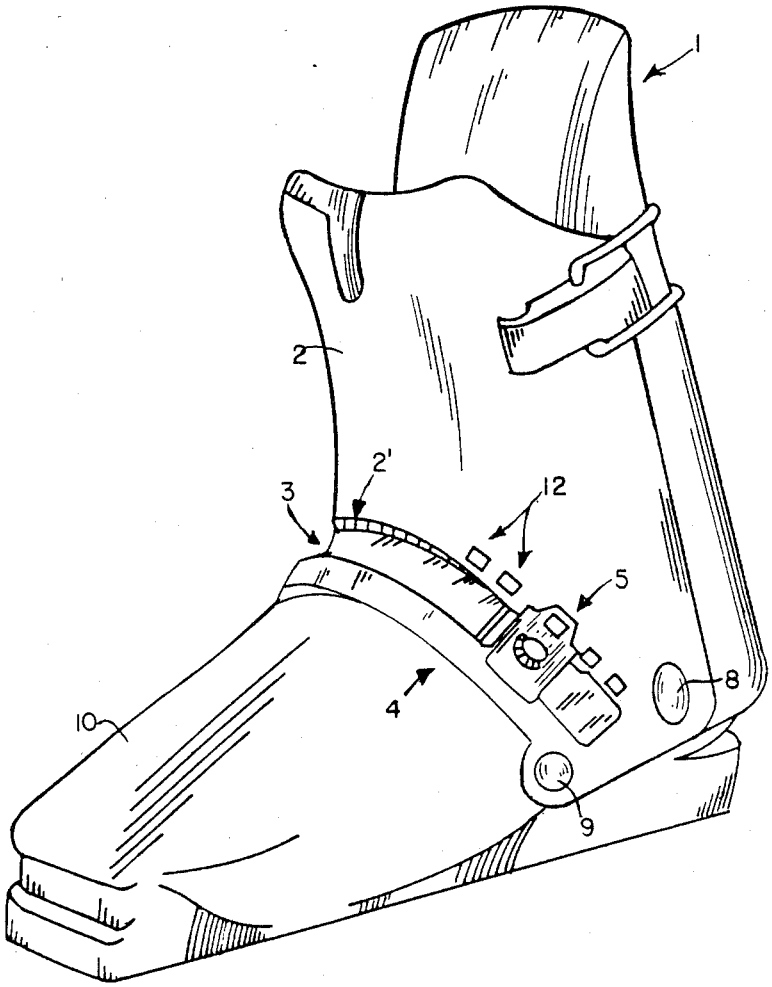
FIG. 8 is a perspective view of an alternative embodiment of the boot in which arch 4 has a constant cross section.

According to an alternative embodiment, the zone in which the journal rivets are attached to the boot can be varied by means of an adjustment adjustment apparatus 29 which permits displacement of the energization rivets 30 on each side of the shell base as seen in FIG. 7.

Although the invention has been described with reference to particular means, materials and embodiments, it is to be understood that the invention is not limited to the specifics disclosed and extends to all equivalents within the scope of the claims.

What is claimed is:

1. A ski boot having an instep, comprising:

(a) an upper comprising a front portion having a bottom portion;

(b) a shell base having two lateral sides;

(c) means for controlling the rigidity and flexional characteristics of said boot, wherein said control means comprises:

(i) a flexion band comprising an arch having two ends, wherein said arch extends across said instep of said boot, and two substantially horizontal lateral arms each attached to one end of said arch and extending along one lateral side of the shell base, and connected to said bottom portion of said front portion of said upper; and (ii) means for maintaining a portion of said flexion band at a fixed position with respect to said shell base, wherein said fixed position is substantially in a zone in which said arch is connected to each of said lateral arms; and (d) a journal, spaced from said fixed position, wherein said upper is adapted to pivot at least partially on said shell base around said journal, wherein each lateral arm extends continously between said fixed position and said journal.

2. The ski boot defined by claim 1 wherein said shell base has a top portion and said arch is slidably mounted on said top portion of said shell base.

3. The ski boot as defined by claim 1 wherein said arch has a constant cross-section.

4. The ski boot as defined by claim 1 wherein said arch has a variable cross-section.

5. The ski boot as defined by claim 1 wherein said shell base further comprises a shoulder positioned on at least one portion of said shell base, wherein said shoulder abuts at least a portion of said flexion band.

6. The ski boot as defined by claim 5 wherein one end of said arch comprises an internal end and wherein the said arch comprises a lateral internal portion extending from a substantially median point along the length of said arch to said internal end of said arch, and wherein said lateral internal portion of said arch comprises said portion of said arch abutting said shoulder.

7. The ski boot as defined by claim 6 wherein the other end of said arch comprises an external end, and wherein said arch further comprises a lateral external portion extending from a substantially median point along the length of said arch to said external end of said arch, wherein said lateral internal portion of the arch abutting said shoulder of said shell base is of constant cross-section, and wherein said lateral external portion of the arch is of variable cross-section.

8. The ski boot as defined by claim 1 wherein said maintenance means comprises two fixed rivets, wherein said rivets define first and second deformation zones adapted to be deformed to different extents.

9. The ski boot as defined by claim 8 wherein said first deformation zone comprises the portion of said lateral arms extending from said end connected to said upper to said rivet, and wherein said second deformation zone comprises the portion of said arch extending between said rivets.

10. The ski boot as defined by claim 1 wherein said boot further comprises adjustment means for adjusting the position of said maintenance means, wherein said adjustment means are positioned on each side of said boot.

11. The ski boot defined by claim 10 further comprising first and second deformation zones, wherein said first deformation zone comprises a portion of said lateral arms extending from said end connected to said upper to said adjustment means, and wherein said second deformation zone comprises a portion of said arch extending between said fixed positions.

12. The boot defined by claim 1 wherein said lateral arms are elastically deformable and comprise a first deformation zone, and wherein said arch extending between said fixed positions is deformable and comprises a second deformation zone.

13. The boot defined by claim 12 wherein said journal element extends through said upper and attaches said upper to said shell base.

14. A ski boot having an instep portion, comprising:

(a) a shell base having two lateal sides;

(b) an upper at least partially journalled at a journal point on said shell base, comprising a front portion having a bottom portion; and (c) a flexion band integral with said upper, comprising:

(i) an instep portion, extending across said instep of said boot and having two ends; and (ii) two substantially horizontal lateral arms each extending from one of said ends of said instep portion of said flexion band to said bottom portion of said front portion of said upper; and (d) means for maintaining a portion of each lateral arm of said flexion band in a fixed position with respect to said shell base, wherein said fixed position is spaced from said journal point and wherein each lateral arm extends continuously between said fixed position and said journal point.

15. The boot defined by claim 14 wherein said maintenance means extends through said lateral arms and connects said lateal arms with said shell base.

16. The boot defined by claim 14 wherein said boot comprises malleoli zones and said journal point is positioned in said malleoli zones of said boot.

17. The boot defined by claim 16 wherein said maintenance means comprise rivets.

18. The boot defined by claim 14 wherein said shell base comprises a top portion and wherein said instep portion of said flexion band is slidably mounted on said top portion of said shell base.

19. The boot defined by claim 14 wherein said upper further comprises a cuff having a lower portion, and a groove positioned between said lower portion of said cuff and said instep portion of said flexion band.

20. The boot defined by claim 17 further comprising force transmission means for transmitting a force of flexion from said lower portion of said cuff to said instep portion of said flexion band.

21. The boot defined by claim 20 wherein said force transmission means engages said groove and is adapted to be adjusted along the length of said groove.

22. The boot defined by claim 21 wherein said lower portion of said cuff is adapted to slide over said shell base and contact said flexion band in response to forward flexion of said boot.

23. The boot defined by claim 22 wherein said groove has a notch at each lower portion thereof and an intermediate portion between said notches, ends, wherein said notch has a width greater than said intermediate portion of said groove.

24. The boot defined by claim 22 further comprising retaining means for retaining said force transmission means at any point along the length of said groove.

25. The boot defined by claim 22 wherein said lateral arms are elastically deformable and elastically deform in response to forward flexion said boot.

26. The boot defined by claim 25 wherein said flexion band is elastically deformable and elastically deforms in response to flexion of said boot.

27. The boot defined by claim 26 wherein said force transmission means comprises at least one cursor.

28. the boot defined by claim 27 wherein said cuff comprises a lower edge and said flexion band comprises an upper edge and wherein said cursor is adpated to contact and slide over said lower edge of said cuff and said upper edge of said flexion band.

29. The boot defined by claim 28 wherein said cursor comprises upper and lower tightening flaps adapted to grip, respectively, said bottom portions of said lower edge of said cuff and said top portion of said lower edge of said flexion band.

30. The boot defined by claim 29 wherein said cursor further comprises tightening means for actuating said tightening flaps to grip said cuff and flexion band.

31. The boot defined by claim 30 wherein said cursor comprises a rounded portion and said lower edge of said cuff and said upper edge of said flexion band comprises rounded guide tracks adapted to engage said corresponding rounded portion on said cursor.

* * * * *

UNITED STATES PATENT AND TRADEMARK OFFICE

CERTIFICATE OF CORRECTION

PATENT NO. : 4,577,420

DATED : March 25, 1986

INVENTOR(S) : Roland PETRINI et al.

It is certified that error appears in the above-identified patent and that said Letters Patent is hereby corrected as shown below:

Column 1, line 13, change "sheel" to ---shell---;
column 1, line 40, change "test" to ---tests---; and
column 1, line 55, change "comporises" to ---comprises.

Column 3, line 19, change "pints" to ---points---;
column 3, line 22, change "proided" to ---provided---; and
column 3, line 40, change "uppe." to ---upper.---.

Column 4, line 47, change "based" to ---base---;
column 4, line 63, change "80.08948" to ---2,480,575---; and
column 4, lines 64 and 65, change "Application S.N. 255,176" to ---Patent No. 4,455,768 ---.

Column 5, line 14, change "cross section" to ---cross-section---;
column 5, line 15, change "cross section" to ---cross-section---;
column 5, line 16, change "whch" to ---which---;
column 5, line 21, change "endge" to ---edge---;
column 5, line 50, change "intial" to ---initial---;
column 5, line 51, change "deformatin" to ---deformation---;
column 5, line 62, change "80.08948" to ---2,480,575---; and
column 5, line 63, change "Application S.N. 255,176" to ---Patent No. 4,455,768---.

Column 6, line 43, change "resistence" to ---resistance---;
column 6, line 44, change "resistence" to ---resistance---; and

UNITED STATES PATENT AND TRADEMARK OFFICE

CERTIFICATE OF CORRECTION

PATENT NO. : 4,577,420

DATED : March 25, 1986

INVENTOR(S) : Roland Petrinieet al.

It is certified that error appears in the above-identified patent and that said Letters Patent is hereby corrected as shown below:

Column 6, line 48, change "preceeding" to ---preceding---.

Column 7, line 63, delete "adjustment" (second occurrence).

Signed and Sealed this

Fifteenth Day of December, 1987

*Attest:*

DONALD J. QUIGG

*Attesting Officer*

*Commissioner of Patents and Trademarks*